US008079402B2

(12) United States Patent
Reese et al.

(10) Patent No.: US 8,079,402 B2
(45) Date of Patent: Dec. 20, 2011

(54) CASTING METHOD FOR MATRIX DRILL BITS AND REAMERS

(75) Inventors: Michael R. Reese, Houston, TX (US); Gilles Gallego, Ibos (FR); Scott Buteaud, Spring, TX (US); Alan K. Harrell, New Waverly, TX (US); Steven W. Drews, Cypress, TX (US)

(73) Assignee: Varel Europe S.A.S., Pau (FR)

( * ) Notice: Subject to any disclaimer, the term of this patent is extended or adjusted under 35 U.S.C. 154(b) by 0 days.

(21) Appl. No.: 13/104,790

(22) Filed: May 10, 2011

(65) Prior Publication Data

US 2011/0209845 A1 Sep. 1, 2011

Related U.S. Application Data

(63) Continuation of application No. 12/578,111, filed on Oct. 13, 2009.

(51) Int. Cl.
*B22D 19/00* (2006.01)
*B22D 19/02* (2006.01)
*B22C 9/00* (2006.01)

(52) U.S. Cl. ..... 164/332; 164/334; 164/349

(58) Field of Classification Search ..... 164/332, 164/333, 334, 349
See application file for complete search history.

(56) References Cited

U.S. PATENT DOCUMENTS 2,344,066 A 3/1944 Taylor
2,371,489 A 3/1945 Williams, Jr.
2,493,178 A 1/1950 Williams, Jr.
3,173,314 A * 3/1965 Blackmer ..... 76/108.1
3,175,260 A 3/1965 Bridwell et al.
3,757,878 A * 9/1973 Wilder et al. ..... 175/434
4,234,048 A 11/1980 Rowley
4,398,952 A 8/1983 Drake
4,423,646 A * 1/1984 Bernhardt ..... 76/108.1
4,460,053 A 7/1984 Jurgens et al.
(Continued)

FOREIGN PATENT DOCUMENTS

GB 2307699 6/1997

OTHER PUBLICATIONS

U.S. Appl. No. 13/013,365, filed Jan. 25, 2011, Gilles Gallego.

*Primary Examiner* — Kevin P Kerns
(74) *Attorney, Agent, or Firm* — King & Spalding LLP

(57) ABSTRACT

An apparatus and method for manufacturing a down hole tool that reduces manufacturing costs and enhances the tool's performance. A belted mold assembly includes a casting assembly, a belt assembly, and a mid-belt. The belted mold assembly is used to fabricate a casting that allows for a larger diameter blank to be used which displaces the more expensive casting material and for using a smaller outer diameter thin-walled mold. The casting assembly is disposed within the belt assembly and the mid-belt is loaded in the volume created between the casting assembly's outer surface and the belt assembly's inner surface. The mid-belt provides a bracing for the casting assembly during the casting process. Optionally, a cap can be disposed on top of the blank for preventing metallurgical bonds from forming between the binder material and the upper portion of the blank. This allows for the excess binder material to remain high in purity so that it can be reprocessed. The cap can be used with the belted mold assembly or with a casting assembly known in the prior art.

19 Claims, 4 Drawing Sheets

U.S. PATENT DOCUMENTS

| | | | | |
|---|---|---|---|---|
| 4,499,795 | A | 2/1985 | Radtke | |
| 4,667,756 | A | 5/1987 | King et al. | |
| 4,884,477 | A | 12/1989 | Smith et al. | |
| 5,373,907 | A | 12/1994 | Weaver | |
| 5,666,864 | A | 9/1997 | Tibbitts | |
| 5,732,783 | A | 3/1998 | Truax et al. | |
| 5,944,128 | A | 8/1999 | Truax et al. | |
| 6,045,750 | A | 4/2000 | Drake et al. | |
| 6,073,518 | A | 6/2000 | Chow et al. | |
| 7,398,840 | B2 | 7/2008 | Ladi et al. | |
| 2008/0156148 | A1* | 7/2008 | Smith et al. | 76/102 |
| 2011/0084420 | A1* | 4/2011 | Reese et al. | 264/219 |
| 2011/0115118 | A1 | 5/2011 | Gallego et al. | |
| 2011/0121475 | A1* | 5/2011 | Reese et al. | 264/37.1 |

* cited by examiner

CASTING METHOD FOR MATRIX DRILL BITS AND REAMERS

RELATED PATENT APPLICATIONS

The present application is a continuation application of U.S. patent application Ser. No. 12/578,111, entitled "Casting Method For Matrix Drill Bits And Reamers" and filed on Oct. 13, 2009, which is incorporated by reference herein.

The present application is related to U.S. patent application No. 13/017,806, entitled "Casting Method For Matrix Drill Bits And Reamers" and filed on Jan. 31, 2011, which is a divisional application of U.S. patent application Ser. No. 12/578,111, entitled "Casting Method For Matrix Drill Bits And Reamers" and filed on Oct. 13, 2009, which are both incorporated by reference herein.

BACKGROUND OF THE INVENTION

This invention relates generally to down hole tools and methods for manufacturing such items. More particularly, this invention relates to infiltrated matrix drilling products including, but not limited to, polycrystalline diamond compact ("PDC") drill bits, natural diamond drill bits, thermally stable polycrystalline ("TSP") drill bits, bi-center bits, core bits, and matrix bodied reamers and stabilizers, and the methods of manufacturing such items.

Full hole tungsten carbide matrix drill bits for oilfield applications have been manufactured and used in drilling since at least as early as the 1940's. FIG. 1 shows a cross-sectional view of a down hole tool casting assembly 100 in accordance with the prior art. The down hole tool casting assembly 100 consists of a thick-walled mold 110, a stalk 120, one or more nozzle displacements 122, a blank 124, a funnel 140, and a binder pot 150. The down hole tool casting assembly 100 is used to fabricate a casting (not shown) of a down hole tool.

According to a typical casting method as shown in FIG. 1, the thick-walled mold 110 is fabricated with a precisely machined interior surface 112, and forms a mold volume 114 located within the interior of the thick-walled mold 110. The thick-walled mold 110 is made from sand, hard carbon graphite, or ceramic. The precisely machined interior surface 112 has a shape that is a negative of what will become the facial features of the eventual bit face. The precisely machined interior surface 112 is milled and dressed to form the proper contours of the finished bit. Various types of cutters (not shown), known to persons of ordinary skill in the art, can be placed along the locations of the cutting edges of the bit and can also be optionally placed along the gage area of the bit. These cutters can be placed during the bit fabrication process or after the bit has been fabricated via brazing or other methods known to persons of ordinary skill in the art.

Once the thick-walled mold 110 is fabricated, displacements are placed at least partially within the mold volume 114 of the thick-walled mold 110. The displacements are typically fabricated from clay, sand, graphite, or ceramic. These displacements consist of the center stalk 120 and the at least one nozzle displacement 122. The center stalk 120 is positioned substantially within the center of the thick-walled mold 110 and suspended a desired distance from the bottom of the thick-walled mold's 110 interior surface 112. The nozzle displacements 122 are positioned within the thick-walled mold 110 and extend from the center stalk 120 to the bottom of the thick-walled mold's 110 interior surface 112. The center stalk 120 and the nozzle displacements 122 are later removed from the eventual drill bit casting so that drilling fluid can flow though the center of the finished bit during the drill bit's operation.

The blank 124 is a cylindrical steel casting mandrel that is centrally suspended at least partially within the thick-walled mold 110 and around the center stalk 120. The blank 124 is positioned a predetermined distance down in the thick-walled mold 110. According to the prior art, the distance between the outer surface of the blank 124 and the interior surface 112 of the thick-walled mold 110 is typically 12 millimeters ("mm") or more so that potential cracking of the thick-walled mold 110 is reduced during the casting process.

Once the displacements 120, 122 and the blank 124 have been positioned within the thick-walled mold 110, tungsten carbide powder 130 is loaded into the thick-walled mold 110 so that it fills a portion of the mold volume 114 that is around the lower portion of the blank 124, between the inner surfaces of the blank 124 and the outer surfaces of the center stalk 120, and between the nozzle displacements 122. Shoulder powder 134 is loaded on top of the tungsten carbide powder 130 in an area located at both the area outside of the blank 124 and the area between the blank 124 and the center stalk 120. The shoulder powder 134 is made of tungsten powder. This shoulder powder 134 acts to blend the casting to the steel and is machinable. Once the tungsten carbide powder 130 and the shoulder powder 134 are loaded into the thick-walled mold 110, the thick-walled mold 110 is typically vibrated to improve the compaction of the tungsten carbide powder 130 and the shoulder powder 134. Although the thick-walled mold 110 is vibrated after the tungsten carbide powder 130 and the shoulder powder 134 are loaded into the thick-walled mold 110, the vibration of the thick-walled mold 110 can be done as an intermediate step before the shoulder powder 134 is loaded on top of the tungsten carbide powder 130.

The funnel 140 is a graphite cylinder that forms a funnel volume 144 therein. The funnel 140 is coupled to the top portion of the thick-walled mold 110. A recess 142 is formed at the interior edge of the funnel 140, which facilitates the funnel 140 coupling to the upper portion of the thick-walled mold 110. Typically, the inside diameter of the thick-walled mold 110 is similar to the inside diameter of the funnel 140 once the funnel 140 and the thick-walled mold 110 are coupled together.

The binder pot 150 is a cylinder having a base 156 with an opening 158 located at the base 156, which extends through the base 156. The binder pot 150 also forms a binder pot volume 154 therein for holding a binder material 160. The binder pot 150 is coupled to the top portion of the funnel 140 via a recess 152 that is formed at the exterior edge of the binder pot 150. This recess 152 facilitates the binder pot 150 coupling to the upper portion of the funnel 140. Once the down hole tool casting assembly 100 has been assembled, a predetermined amount of binder material 160 is loaded into the binder pot volume 154. The typical binder material 160 is a copper alloy.

The down hole tool casting assembly 100 is placed within a furnace (not shown). The binder material 160 melts and flows into the tungsten carbide powder 130 through the opening 158 of the binder pot 150. In the furnace, the molten binder material 160 infiltrates the tungsten carbide powder 130. During this process, a substantial amount of binder material 160 is used so that it fills at least a substantial portion of the funnel volume 144. This excess binder material 160 in the funnel volume 144 supplies a downward force on the tungsten carbide powder 130 and the shoulder powder 134. Once the binder material 160 completely infiltrates the tungsten carbide powder 130, the down hole tool casting assembly 100 is pulled from the furnace and is controllably cooled. The thick-walled mold 110 is broken away from the casting. The casting then undergoes finishing steps which are known to persons of ordinary skill in the art, including the addition of a threaded connection (not shown) coupled to the top portion of the blank 124 and the removal of the binder material 160 that filled at least a substantial portion of the funnel volume 144. Typically, this binder material 160 is not reusable because metallurgical bonds are formed between the binder material 160 and the blank 124 and is not very pure to allow the binder material 160 to be reused. At today's pricing, the binder material 160 is approximately seven dollars per pound. Significant cost reductions can be made if an economical method is found for maintaining the purity of the excess binder material and reusing at least a portion of the excess binder material 160 that filled at least a substantial portion of the funnel volume 144.

Hard carbon graphite is typically used in making the thick-walled mold 110 because it is easily machinable to tight tolerances, conducts furnace heat well, is dimensionally stable at casting temperatures, and provides for a smooth surface finish on the casting. However, a primary drawback in using a hard carbon graphite mold 110 is that it has a lower thermal expansion rate than the steel blank 124 that is disposed within the mold 110 to form the casting around it. As a result of this difference in thermal expansion rate, the diameter of the steel blank 124 is decreased and the diameter of the mold 110 is increased to constrain the forces that are generated during the casting process. These differences in thermal expansion rate between the steel blank 124 and the hard carbon graphite mold 110 create a risk that the graphite mold 110 will crack, thereby destroying the casting.

The primary reason for mold cracking lies in the dissimilarity of the coefficient of thermal expansion of three major components of the down hole tool casting assembly 100. These major components are the steel blank 124, the tungsten carbide powder 130, and the graphite mold 110. The blank 124 has a relatively high coefficient of thermal expansion, while the tungsten carbide powder 130 and the graphite mold 110 have extremely low coefficients of thermal expansion. When the down hole tool casting assembly 100 is heated in a furnace, the outside diameter of the blank 124 expands as the temperature increases, thereby putting pressure on the densely packed tungsten carbide powder 130. The tungsten carbide powder 130 transmits this pressure to the internal diameter of the graphite mold 110, thereby creating hoop stress. If the wall of the graphite mold 110 is too thin, then the hoop stress overcomes the strength of the graphite mold 110 and a crack occurs which leads to the molten binder material 160 leaking through the graphite mold 110, a scrapped casting, and other consequential damages. These consequential damages include loss of material, increased labor costs, missed delivery, very expensive damage to the furnace, and loss of production for several days.

According to one example in the prior art, a twelve and one-fourth inch drill bit casting is typically fabricated using an eighteen inch diameter graphite mold 110 even though the twelve and one-fourth inch drill bit casting physically can be made using a fourteen inch diameter graphite mold 110. The extra four inches in diameter provides a safety factor against the mold 110 from cracking. This safety factor comes at a substantial cost because larger diameters of graphite molds 110 increase in cost per diameter inch along a steeply ascending slope. FIG. 2 shows a graph 200 illustrating the relationship between total graphite diameter 210 versus cost 220. A linear inch of fourteen inch diameter graphite costs approximately fifty dollars, while a linear inch of eighteen inch diameter graphite costs approximately seventy-five dollars. A ten inch tall mold of fourteen inch diameter graphite will have a graphite cost of approximately five hundred dollars, while a ten inch tall mold of eighteen inch diameter graphite will have a graphite cost of seven hundred and fifty dollars. Thus, a significant cost savings can be made in the fabrication of the mold 110 if the safety factor became unnecessary or reduced.

In the prior art, a further step that has been used to mitigate cracking of the graphite mold is to use a smaller diameter blank 124 to reduce hoop stress pressure developed during heating in the furnace. However, this step increases the cost of fabricating the casting because additional expensive tungsten carbide powder 130 is required to fill the mold. At today's pricing, the blank 124 costs approximately fifty cents per pound, while the tungsten carbide powder 130 costs approximately twenty-five dollars per pound. Thus, a significant cost savings can be made in the fabrication of the casting if larger diameter blanks 124 can be used without increasing the risk of cracking the graphite mold 110.

In the prior art, the increased costs associated with fabricating a casting has been tolerated by manufacturers because of the risks and costs associated with mold 110 failure.

In view of the foregoing discussion, need is apparent in the art for improving the casting process so that the costs associated with casting fabrication are decreased. Additionally, a need is apparent for improving the casting process so that some of the costs associated with mold failure are mitigated. Further, a need is apparent for improving the casting process so that a significant portion of the binder material is reusable. Furthermore, a need is apparent for improving the casting process so that a smaller diameter mold is used in the casting process. Moreover, a need is apparent for improving the casting and the casting process so that a smaller volume of tungsten carbide powder is used in the casting process. A technology addressing one or more such needs, or some other related shortcoming in the field, would benefit down hole drilling, for example fabricating castings more effectively and more profitably. This technology is included within the current invention.

BRIEF DESCRIPTION OF THE DRAWINGS

The foregoing and other features and aspects of the invention will be best understood with reference to the following description of certain exemplary embodiments of the invention, when read in conjunction with the accompanying drawings, wherein.

DETAILED DESCRIPTION OF THE INVENTION

This invention relates generally to down hole tools and methods for manufacturing such items. More particularly, this invention relates to infiltrated matrix drilling products including, but not limited to, polycrystalline diamond compact ("PDC") drill bits, natural diamond drill bits, thermally stable polycrystalline ("TSP") drill bits, bi-center bits, core bits, and matrix bodied reamers and stabilizers, and the methods of manufacturing such items. Although the description provided below is related to a drill bit casting, the invention relates to any infiltrated matrix drilling product.

Figure 3:
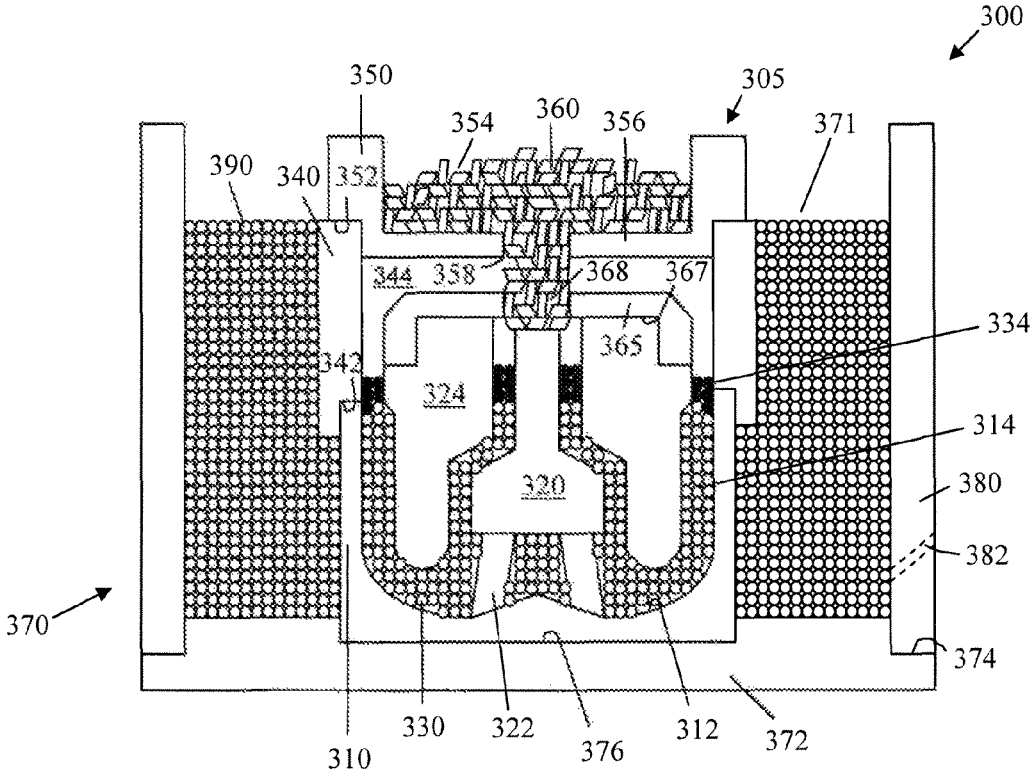
FIG. 3 shows a cross-sectional view of a belted mold assembly in accordance with, an exemplary embodiment.

FIG. 3 shows a cross-sectional view of a belted mold assembly 300 in accordance with an exemplary embodiment. The belted mold assembly 300 includes a down hole tool casting assembly 305, a belt assembly 370, and a mid-belt 390. The belted mold assembly 300 is used to fabricate a casting (not shown) of a down hole tool that allows for a larger diameter blank 324 to be used which displaces the more expensive casting material 330 and for use of a smaller outer diameter thin-walled mold 310. The belted mold assembly 300 maintains or increases the current level of crack resistance afforded by the thick-walled molds of the prior art.

The down hole tool casting assembly 305 includes a thin-walled mold 310, a stalk 320, one or more nozzle displacements 322, a blank 324, a casting material 330, a funnel 340, and a binder pot 350. According to an exemplary embodiment shown in FIG. 3, the thin-walled mold 310 is fabricated according to processes known to persons having ordinary skill in the art. The thin-walled mold 310 has a precisely machined interior surface 312. The structure of the thin-walled mold 310 forms a mold volume 314 located within its interior. The precisely machined interior surface 312 has a shape that is a negative of what will become the facial features of the eventual bit face (not shown). The precisely machined interior surface 312 is milled and dressed to form the proper contours of the finished bit. Various types of cutters (not shown), known to persons having ordinary skill in the art, can be placed along the locations of the cutting edges of the finished bit and can also be optionally placed along the gage area of the bit. These cutters can be placed during the bit casting process or after the bit has been fabricated via brazing or other methods known to persons having ordinary skill in the art.

The thin-walled mold 310 is made from sand, hard carbon graphite, ceramic, or any other suitable material known to persons having ordinary skill in the art. Some advantages for using hard carbon graphite are that hard carbon graphite is easily machinable to tight tolerances, conducts furnace heat well, is dimensionally stable at casting temperatures, and provides for a smooth surface finish on the casting. According to some exemplary embodiments, the wall thickness of the thin-walled mold 310 ranges from about three-eighths inch to about two and one-half inches.

The thin-walled mold 310 can be fabricated as a single component or in multiple components. Although not illustrated, the thin-walled mold 310 can be fabricated to include a lower mold and a gage ring. Alternatively, exemplary embodiments can use a single component thin-walled mold 310 by using the technology embodied in currently pending U.S. patent application Ser. No. 12/180,276, entitled "Single Mold Milling Process For Fabrication Of Rotary Bits To Include Necessary Features Utilized For Fabrication In Said Process," which allows for a single mold body without the need for a separate gage ring. U.S. patent application Ser. No. 12/180,276 is incorporated by reference herein in its entirety.

Once the thin-walled mold 310 is fabricated, displacements are placed at least partially within the mold volume 314 of the thin-walled mold 310. The displacements are typically fabricated from clay, sand, graphite, ceramic, or any other suitable material known to persons having ordinary skill in the art. These displacements include the center stalk 320 and the at least one nozzle displacement 322. The center stalk 320 is positioned substantially within the center of the thin-walled mold 310 and suspended a desired distance from the bottom of the thin-walled mold's 310 interior surface 312. The nozzle displacements 322 are positioned within the thin-walled mold 310 and extend from the center stalk 320 to the bottom of the thin-walled mold's 310 interior surface 312. The center stalk 320 and the nozzle displacements 322 are removed subsequently from the eventual drill bit casting so that drilling fluid can flow though the center of the finished bit during the drill bit's operation.

The blank 324 is a cylindrical steel casting mandrel that is centrally suspended at least partially within the thin-walled mold 310 and around the center stalk 320. The blank 324 is positioned a predetermined distance down in the thin-walled mold 310 and extends closer to the bottom of the thin-walled mold's 310 interior surface 312 than the blanks used in the prior art. For the same diameter casting, the blank 324 also has a diameter that is larger than the diameter of a typical blank that is used in the prior art. This larger diameter blank 324 allows for a reduced consumption of casting material 330 because the blank 324 occupies more volume. The placement of the blank 324 around the center stalk 320 within the thin-walled mold 310 creates a first space between the outer surface of the blank 324 and the interior surface 312 of the thin-walled mold 310 and a second space between the interior surface of the blank 324 and the outer surface of the stalk 320. According to one exemplary embodiment, the distance between at least a portion of the outer surface of the blank 324 and the interior surface 312 of the thin-walled mold 310 ranges from about four millimeters to about ten millimeters. According to another exemplary embodiment, the distance between at least a portion of the outer surface of the blank 324 and the interior surface 312 of the thin-walled mold 310 ranges from about five millimeters to about eight millimeters. In yet another exemplary embodiment, the distance between at least a portion of the outer surface of the blank 324 and the interior surface 312 of the thin-walled mold 310 is about five millimeters. Although this exemplary embodiment illustrates the blank 324 being fabricated from steel, other suitable materials known to those having ordinary skill in the art, including, but not limited to steel alloys, can be used without departing from the scope and spirit of the exemplary embodiment.

Once the displacements 320, 322 and the blank 324 have been positioned within the thin-walled mold 310, a casting material 330 is loaded into the thin-walled mold 310 so that it fills a portion of the mold volume 314 that is around at least the lower portion of the blank 324, between the inner surfaces of the blank 324 and the outer surfaces of the center stalk 320, and between the nozzle displacements 322. The casting material 330 is tungsten carbide powder or any other suitable material known to persons having ordinary skill in the art, including, but not limited to any suitable powder metal. The casting material 330 is angularly shaped, but can alternatively be spherically shaped or shaped in any other suitable geometric pattern.

Shoulder powder 334 is loaded on top of the casting material 330 in areas located at both the area between the outer surface of the blank 324 and the interior surface 312 of the thin-walled mold 310 and the area between the inner surface of the blank 324 and the outer surface of the center stalk 320. The shoulder powder 334 is made of tungsten powder or any other suitable material known to persons having ordinary skill in the art. The shoulder powder 334 is angularly shaped, but can alternatively be spherically shaped or shaped in any other suitable geometric pattern. This shoulder powder 334 acts to blend the casting to the steel and is machinable.

Once the casting material 330 and the shoulder powder 334 are loaded into the thin-walled mold 310, the casting material 330 and the shoulder powder 334 are compacted within the thin-walled mold 310. One method for compacting the casting material 330 and the shoulder powder 334 is to vibrate the thin-walled mold 310 so that the casting material 330 and the shoulder powder 334 are compressed into a smaller volume. Although one method for compacting the casting material 330 and the shoulder powder 334 is described, other methods for compacting the casting material 330 and the shoulder powder 334 can be used, including application of force from above the casting material 330 and the shoulder powder 334, without departing from the scope and spirit of the exemplary embodiment. Although the thin-walled mold 310 is vibrated after the casting material 330 and the shoulder powder 334 are loaded into the thin-walled mold 310, the vibration of the thin-walled mold 310 can be done as an intermediate step before the shoulder powder 334 is loaded on top of the casting material 330. Alternatively, the compacting the casting material 330 and the shoulder powder 334 can be performed later when the mid-belt 390 is compacted, which is described below.

The funnel 340 is a graphite cylinder that forms a funnel volume 344 therein. The funnel 340 is coupled to the top portion of the thin-walled mold 310. A recess 342 is formed at the interior edge of the funnel 340, which facilitates the funnel 340 coupling to the upper portion of the thin-walled mold 310. According to one exemplary embodiment, the inside diameter of the thin-walled mold 310 is similar to the inside diameter of the funnel 340 once the funnel 340 and the thin-walled mold 310 are coupled together. Although this exemplary embodiment illustrates the funnel 340 being fabricated from graphite, other suitable materials known to those having ordinary skill in the art can be used without departing from the scope and spirit of the exemplary embodiment. Although one method for coupling the funnel 340 to the upper portion of the thin-walled mold 310 is described, other methods known to persons having ordinary skill in the art can be used without departing from the scope and spirit of the exemplary embodiment.

The binder pot 350 is a cylinder having a base 356 with an opening 358 located at the base 356 and which also extends through the base 356. The binder pot 350 also forms a binder pot volume 354 therein for holding a binder material 360. The binder pot 350 is coupled to the top portion of the funnel 340 via a recess 352 that is formed at the exterior edge of the binder pot 350. This recess 352 facilitates the binder pot 350 coupling to the upper portion of the funnel 340. Once the down hole tool casting assembly 305 has been assembled, a predetermined amount of binder material 360 is loaded into the binder pot volume 354. The binder material 360 is a copper alloy or other suitable material known to persons having ordinary skill in the art and is loaded into the binder pot volume 354 prior to being heated in a furnace (not shown), which is further described below. The proper amount of binder material 360 that is to be used is calculable by persons having ordinary skill in the art. Although one method for coupling the binder pot 350 to the funnel 340 is described, other methods known to persons having ordinary skill in the art can be used without departing from the scope and spirit of the exemplary embodiment.

The belt assembly 370 includes a base plate 372 and an outer belt 380 coupled to the outer perimeter of the base plate 372, which collectively defines a belt volume 371 therein. The base plate 372 has a larger diameter than the thin-walled mold 310. The base plate 372 can be any suitable shape, including but not limited to, round, square, elliptical, or any other geometric shape. The base plate 372 is fabricated from graphite, ceramic, stainless steel, Inconel™, or any other suitable material known to persons having ordinary skill in the art. In some embodiments, the base plate 372 comprises an outer perimeter recess 374 to facilitate the coupling of the outer belt 380 to the base plate 372. Although some embodiments have the outer perimeter recess 374 entirely around the outer perimeter of the base plate 372, alternative embodiments can have the outer perimeter recess 374 around portions of the outer perimeter of the base plate 372 without departing from the scope and spirit of the exemplary embodiment. According to these exemplary embodiments, the lower portion of the outer belt 380 has a negative profile of the outer perimeter of the base plate 372 so that proper coupling of the base plate 372 to the outer belt 380 occurs. Although one method for coupling the base plate 372 to the outer belt 380 is described, other methods known to persons having ordinary skill in the art can be used without departing from the scope and spirit of the exemplary embodiment.

Further, according to some exemplary embodiments, the base plate 372 includes a mating socket 376 that is shaped according to the bottom profile of the thin-walled mold 310. In some exemplary embodiments, the mating socket 376 is cylindrical and ranges in depth from about one-fourth inch to about two inches. However, in alternative embodiments, the shape and depth of the mating socket 376 can differ without departing from the scope and spirit of the exemplary embodiment. This mating socket 376 is located away from the outer perimeter of the base plate 372. In some exemplary embodiments, the mating socket 376 is located substantially in the center of the base plate 372.

The outer belt 380 can also be any suitable shape, including but not limited to, round, square, elliptical, or any other geometric shape. According to the embodiment shown in FIG. 3, the outer belt 380 is cylindrical in shape and is coupled to the outer perimeter of the base plate 372. The outer belt 380 is fabricated from graphite, ceramic, stainless steel, Inconel™, or any other suitable material known to persons having ordinary skill in the art. The outer belt 380 is typically about four inches greater in diameter than the outer diameter of the thin-walled mold 310, thereby leaving about a two inch wide cylindrical gap between the outer surface of the thin-walled mold 310 and the inner surface of the outer belt 380. This two inch wide cylindrical gap can be greater or less in various exemplary embodiments.

Additionally, according to some embodiments, the outer belt 380 includes at least one vacuum port 382, wherein the vacuum ports 382 extend through the thickness of the outer belt 380. These vacuum ports 382 are located at the lower portion of the outer belt 380. Alternatively or additionally, the vacuum ports 382 can be located through the thickness of the base plate 372 without departing from the scope and spirit of the exemplary embodiment. These vacuum ports 382 can be used to facilitate the compaction of the mid-belt 390, which is further described below.

Once the belt assembly 370 is assembled, the down hole tool casting assembly 305 is placed within the belt assembly 370 in the belt volume 371. According to this exemplary embodiment, the down hole tool casting assembly 305 is coupled to the belt assembly by placing it within the mating socket 376. The mid-belt 390 is loaded into a substantial portion of the remaining belt volume 371 between the outer perimeter of the down hole tool casting assembly 305 and the inner perimeter of the outer belt 380. In some exemplary embodiments, the mid-belt 390 is loaded into the remaining belt volume 371 so that it completely surrounds the outer surfaces of the thin-walled mold 310 and the funnel 340. The mid-belt 390 is made from silica, ceramic beads, carbon sand, graphite powder, unbonded sand, foundry sand, or other suitable material known to persons having ordinary skill in the art. The mid-belt 390 is angularly shaped so that the mid-belt 390 can be better compacted. However, other exemplary embodiments can use spherically shaped materials or a combination of angularly shaped and spherically shaped materials.

Once the mid-belt 390 is loaded into the belt volume 371, the mid-belt 390 is compacted within the belt assembly 370. One method for compacting the mid-belt 390 is to vibrate the belted mold assembly 300 so that the mid-belt 390 is compressed into a smaller volume. Another method for compacting the mid-belt 390 is to apply a downward physical pressure on the top of the mid-belt 390 to compress it into a smaller volume. One way to accomplish this physical compaction of the mid-belt 380 is to temporarily place a properly sized ring (not shown) on top of the mid-belt 380 and apply weight or downward force to the ring. Yet, another method for compacting the mid-belt 390 is to pull a vacuum within the belt volume 371 using the vacuum ports 382 located at the lower portion of the outer belt 380 and/or the base plate 372. Alternatively, a combination of the methods previously mentioned can be used to compact the mid-belt 390. Although some methods for compacting the mid-belt 390 have been described, other methods known to persons having ordinary skill in the art can be used without departing from the scope and spirit of the exemplary embodiment. Sufficient compaction of the mid-belt 390 is important to provide a sufficient confining pressure on the outside of the thin-walled mold 310, or a brace. This confining pressure provides the thin-walled mold 310 the ability to withstand hoop stresses as well as or better than the prior art thick-walled molds.

In the unlikely event that the thin-walled mold 310 does crack during heating, perhaps due to an undetected flaw in the thin-walled mold 310, the granular material of the mid-belt 380 will stop the leaked binder material 360 potentially saving the casting and preventing damage to the furnace from the molten binder material 360.

The belted mold assembly 300 is placed within a furnace (not shown) and is heated and controlled cooled as is known to persons having ordinary skill in the art. During the casting process, the binder material 360 melts and flows into the casting material 330 through the opening 358 of the binder pot 350. In the furnace, the molten binder material 360 infiltrates the casting material 330 and the shoulder powder 334. During this process, a substantial amount of binder material 360 is used so that it fills at least a substantial portion of the funnel volume 344. This excess binder material 360 in the funnel volume 344 supplies a downward force on the casting material 330 and the shoulder powder 334.

During the casting process, the outside diameter of the blank 324 expands as the temperature increases, thereby putting pressure on the densely packed casting material 330. The casting material 330 transmits this pressure to the internal diameter of the thin-walled mold 110, thereby creating hoop stress. As previously mentioned, the mid-belt 390 braces the outer surface of the thin-walled mold 310 to prevent cracking of the thin-walled mold 310. As the casting material 330 applies a force to the inner surface of the thin-walled mold 310, the outer surface of the thin-walled mold 310 applies a force to the mid-belt 390. The mid-belt 390 consequently applies an equal force back to the outer surface of the thin-walled mold 310 so that the thin-walled mold does not crack. Although the belt assembly 370 and the mid-belt 390 provide one example for bracing the outer surface of the thin-walled mold 310, other bracing techniques can be used without departing from the scope and spirit of the exemplary embodiment.

Once the furnacing has been completed and the belted mold assembly 300 has been control cooled, the granular material of the mid-belt 390 is unloaded from the belted mold assembly 300 manually or by suction for cleaning and reuse. The outer belt 380, the funnel 340, the binder pot 350, and the base plate 372 are all recovered for multiple reuses. The sacrificial thin-walled mold 310 is then broken away from the casting and discarded. The casting is then processed into a finished bit as is known by persons having ordinary skill in the art.

According to another exemplary embodiment, a cap 365 is coupled to the upper portion of the blank 324 to prevent a metallurgical bond from forming between the binder material 360 and the upper portion of the blank 324 during the casting process. This metallurgical bond is not formed because the cap 365 prevents the binder material 360 from wetting the upper portion of the blank 324. In this embodiment, the cap 365 is coupled to and covers at least the top surface of the blank 324. The cap 365 is a thin cylindrical cap having an opening 368 extending through the center of the cap 365. The cap 365 includes a turned socket 367 at the end which couples to the upper portion of the blank 324. The turned socket 367 matches the geometric configuration of the top surface of the blank 324 so that the cap 365 couples to and covers the outer perimeter of the upper side portion of the blank 324. Although the cap 365 is circular in this embodiment, other exemplary embodiments can have a cap that is shaped in a square, rectangular, oval, or any other geometric shape. The cap 365 can be fabricated from graphite, ceramic, or any other suitable thermally stable material. Use of the cap 365 allows the excess solidified binder material 360, which is located within the funnel volume 144, to be parted off and recovered in machining as a single piece. The recovered solidified binder material 360 is approximately fifty percent of the original binder material 360 weight and has a high purity because it has not been comingled with steel shavings from the traditional blank machining process. The pure binder material 360 can then be sold or reprocessed, which results in increased cost savings.

Figure 1:
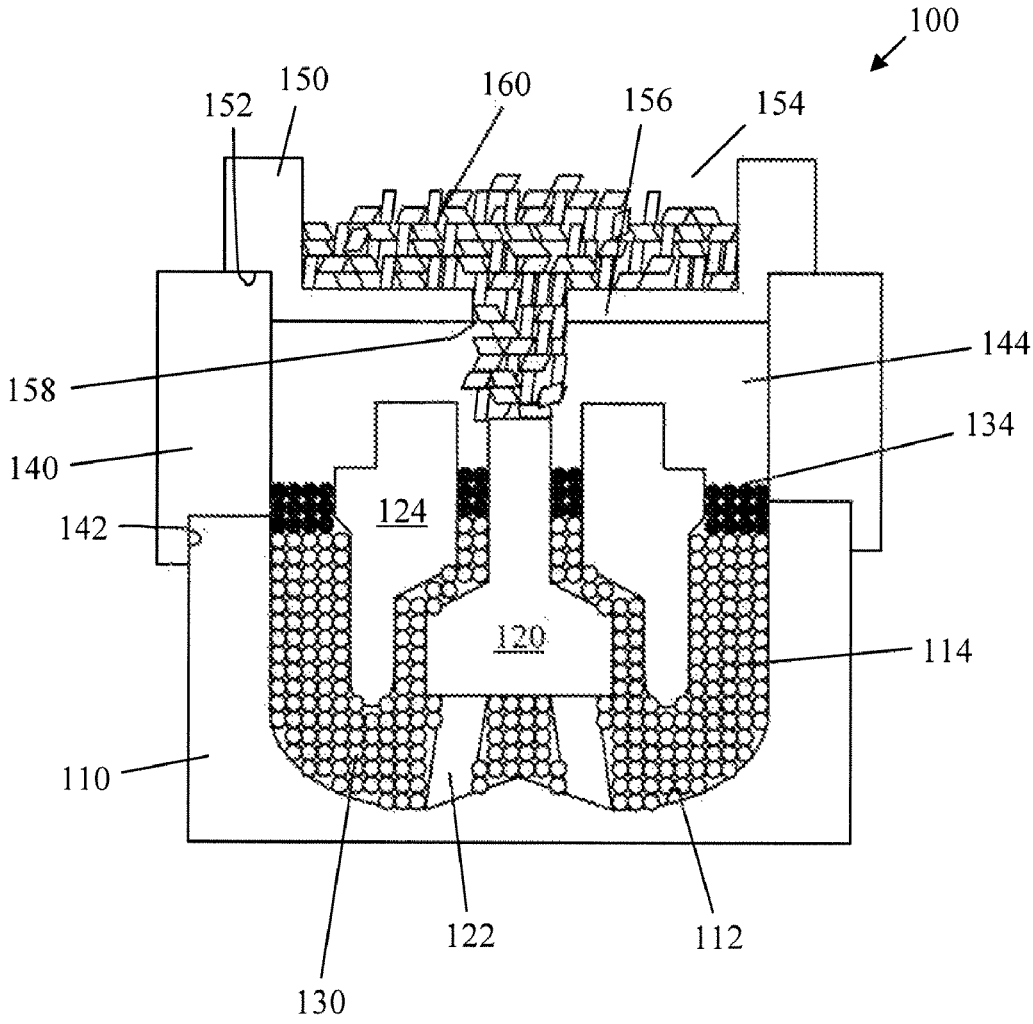
FIGURE 1 (Prior Art)
FIG. 1 shows a cross-sectional view of a down hole tool casting assembly in accordance with the prior art.
Figure 2:
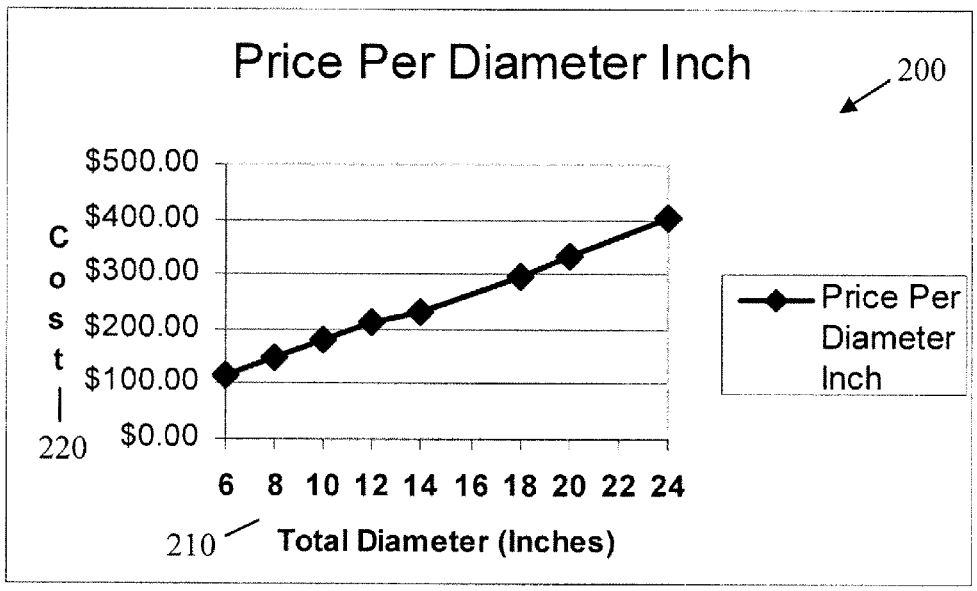
FIG. 2 shows a graph illustrating the relationship between total graphite diameter versus cost.
Figure 4:
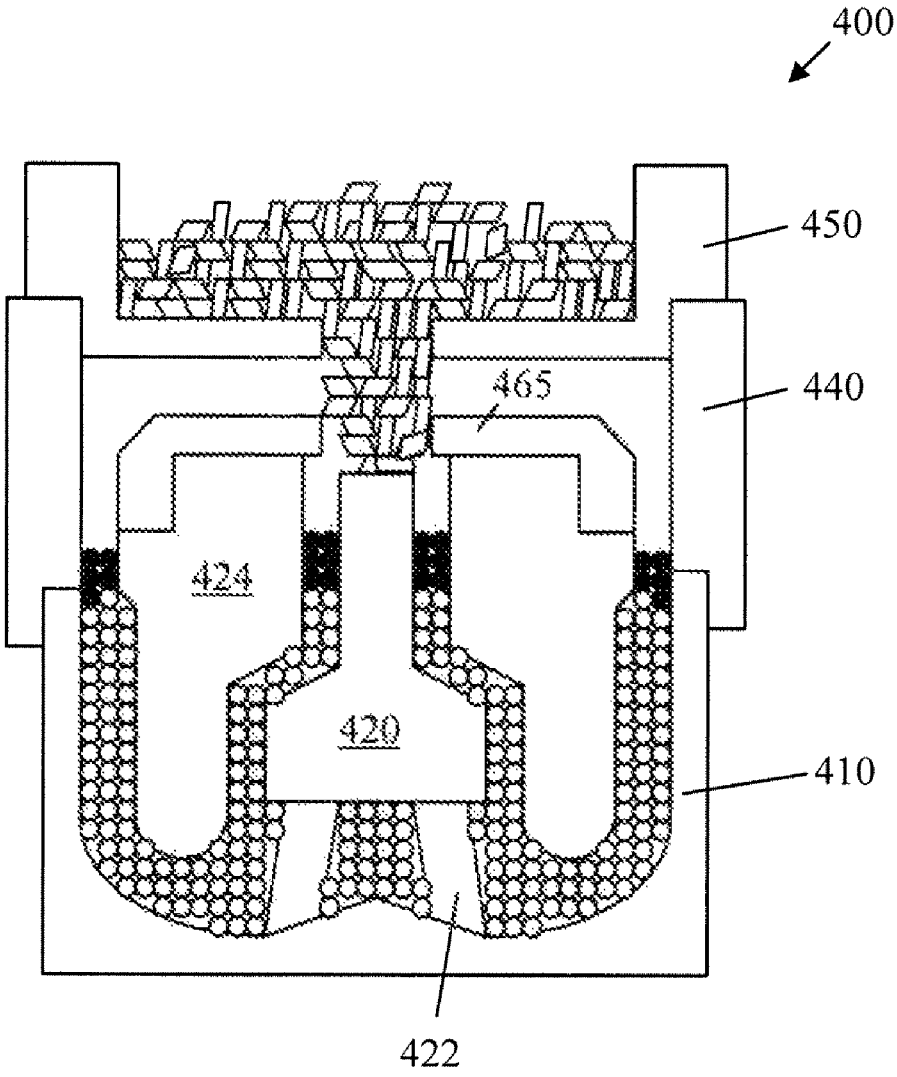
FIG. 4 shows a cross-sectional view of a down hole tool casting assembly in accordance with another exemplary embodiment.

FIG. 4 shows a cross-sectional view of a down hole tool casting assembly 400 in accordance with another exemplary embodiment. The down hole tool casting assembly 400 is similar to the down hole tool casting assembly 100 of the prior art, as shown in FIG. 1, in that the down hole tool casting assembly 400 includes a thick-walled mold 410, a stalk 420, one or more nozzle displacements 422, a blank 424, a funnel 440, and a binder pot 450. However, the down hole tool casting assembly 400 differs from the down hole tool casting assembly 100 of the prior art at least in that the down hole tool casting assembly 400 also includes a cap 465 that is coupled to the upper portion of the blank 424.

The fabrication, construction, and coupling of the stalk 420, the nozzle displacements 422, the funnel 440, and the binder pot 450 have already been described above with respect to similar components shown in FIGS. 1 and 3. The fabrication, construction, and coupling of the thick-walled mold 410 and the blank 424 have already been described above with respect to similar components shown in FIG. 1. However, the materials used to fabricate the thick-walled mold 410 and the blank 424 can be expanded to use the same materials described for fabricating the thin-walled mold 310 and the blank 324 of FIG. 3, respectively. The blank 424 has a smaller outside diameter than the outside diameter of the blank 324 for the casting of the same size drill bit.

The cap 465 is similar to the cap 365 of FIG. 3 and provides for the same advantages as described for the cap 365 of FIG. 3. The method for manufacturing a down hole tool using this down hole tool casting assembly 400 also is similar to the process described with respect to FIG. 3, except that a belt assembly 370 and a mid-belt 390 are not utilized.

With respect to the belted mold assembly 300 and the methods for using the belted mold assembly 300, as shown in FIG. 3, in-house testing has shown that approximately fifty percent of the sacrificial graphite, or the mold material, can be saved in the manufacture of a bit by using the method of this invention. Additionally and more importantly, testing has shown that larger diameter blanks can be safely used with the belted mold assembly 300 and a reduction of approximately twenty-five percent of casting material 330 is realized.

There are several advantages of the belted mold assembly 300. First, the amount and cost of sacrificial graphite, or mold material, is greatly reduced. Secondly, many of the components of the belted mold assembly 300 can be recovered for reuse in multiple casting assemblies, thereby reducing cost, waste, and disposal volume. Third, the method of casting using the belted mold assembly 300 allows for larger diameter blanks 324 with attendant cost savings in reduced casting material 330 usage. As a result of using less casting material 330, there is a reduction in the amount of binder material 360 needed to achieve complete infiltration. Another advantage is that the ductility and impact strength of the overall bit is increased by using larger diameter blanks. A further advantage is that the method using the belted mold assembly 300 greatly decreases the potential for furnace damage in the unlikely event that a mold leak does occur. Moreover, any embodiment that includes the cap 365, 465 allows for easy isolation and recovery of the high value excess binder material 360 for reprocessing.

Although the invention has been described with reference to specific embodiments, these descriptions are not meant to be construed in a limiting sense. Various modifications of the disclosed embodiments, as well as alternative embodiments of the invention will become apparent to persons skilled in the art upon reference to the description of the invention. It should be appreciated by those skilled in the art that the conception and the specific embodiments disclosed may be readily utilized as a basis for modifying or designing other structures for carrying out the same purposes of the invention. It should also be realized by those skilled in the art that such equivalent constructions do not depart from the spirit and scope of the invention as set forth in the appended claims. It is therefore, contemplated that the claims will cover any such modifications or embodiments that fall within the scope of the invention.

What is claimed is:

1. A belted mold assembly, comprising:

a down hole tool casting assembly comprising:

a mold having an interior surface that defines a mold volume therein;

a blank suspended at least partially within the mold volume, the blank comprising a top end, a bottom end, and an internal surface extending from the top end to the bottom end and surrounding a first channel formed therein that extends from the top end to the bottom end;

a casting material disposed within the mold volume;

a cap coupled to the upper portion of the blank, wherein the cap is positioned adjacent to at least the top end of the blank, the cap defining a second channel extending axially through the entire thickness of the cap, at least a portion of the second channel being axially aligned above the first channel;

a binder pot disposed elevationally above the cap and comprising a base and a sidewall extending outwardly from the base, the base defining an opening therein that extends through the thickness of the base, the sidewall defining a binder pot volume therein; and a belt assembly comprising:

a base plate;

an outer belt coupled to the outer perimeter of the base plate, the outer belt and the base plate defining a belt volume therein; and a mid-belt, wherein the down hole tool casting assembly is positioned within the belt volume and wherein the mid-belt is loaded into at least a portion of the belt volume that is located between the outer perimeter of the down hole tool casting assembly and the inner perimeter of the outer belt.

2. The belted mold assembly of claim 1, wherein the base plate comprises a mating socket, the mold of the down hole tool casting assembly coupled to the mating socket of the base plate.

3. The belted mold assembly of claim 1, wherein the mid-belt comprises a granular material.

4. The belted mold assembly of claim 3, wherein the granular material is angularly-shaped.

5. The belted mold assembly of claim 3, wherein the mid-belt comprises at least one material selected from a group consisting of silica, ceramic beads, carbon sand, graphite powder, and unbonded sand.

6. The belted mold assembly of claim 1, wherein the cap comprises a socket, the socket being coupled to the upper portion of the blank.

7. The belted mold assembly of claim 1, wherein the belt assembly comprises a vacuum port.

8. The belted mold assembly of claim 1, wherein the outer belt and the base plate are fabricated as a single component.

9. The belted mold assembly of claim 1, wherein the distance between at least a portion of the outer surface of the blank and the interior surface of the mold ranges from about four millimeters to about ten millimeters.

10. The belted mold assembly of claim 9, wherein the distance between at least a portion of the outer surface of the blank and the interior surface of the mold ranges from about five millimeters to about eight millimeters.

11. The belted mold assembly of claim 1, wherein the mold has a wall thickness ranging from about three-eighths inch to about two and one-half inches.

12. The belted mold assembly of claim 1, wherein the down hole tool casting assembly further comprises a binder material disposed within the binder pot volume, the binder material flowing into at least a portion of the casting material through the opening and the first and second channels upon being melted.

13. A down hole tool casting assembly comprising:

a mold having an interior surface, the mold defining a mold volume therein;

a blank suspended at least partially within the mold volume, the blank comprising an upper portion comprising a top surface and a lower portion positioned below the upper portion, the blank defining a first channel extending axially therethrough;

a casting material disposed within the mold volume surrounding at least a portion of the blank; and a cap defining a second channel extending axially therethough, the cap being coupled to the upper portion of the blank, wherein the cap is positioned adjacent to at least the top surface of the blank and covers at least the top surface of the blank, wherein the second channel is in communication with the first channel.

14. The down hole tool casting assembly of claim 13, wherein at least a portion of the cap is positioned adjacent to the outer perimeter of the top surface and extends toward the lower portion, thereby covering at least a portion of the outer perimeter of the upper portion of the blank.

15. The down hole tool casting assembly of claim 13, further comprising:

a funnel coupled to the top portion of the mold, the funnel defining a funnel volume therein;

a binder pot having a base coupled to the top portion of the funnel, the base defining an opening therein, the opening extending through the thickness of the base, and the binder pot defining a binder pot volume therein.

16. The down hole tool casting assembly of claim 13, wherein the cap comprises a socket, the socket being coupled to the upper portion of the blank.

17. The down hole tool casting assembly of claim 13, wherein the perimeter of the upper portion of the blank is smaller than the perimeter of the lower portion of the blank.

18. The down hole tool casting assembly of claim 13, wherein the perimeter of the cap is substantially the same as the perimeter of the lower portion of the blank.

19. The down hole tool casting assembly of claim 13, further comprising:

a stalk suspended at least partially within the mold; and one or more nozzle displacements positioned within the mold and extending from the stalk to the interior surface of the mold, wherein at least a portion of the stalk is positioned axially within the first channel.

* * * * *